US006352112B1

(12) United States Patent
Mills

(10) Patent No.: US 6,352,112 B1
(45) Date of Patent: Mar. 5, 2002

(54) FLEXIBLE SWAGE

(75) Inventor: Aubrey C. Mills, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/492,999

(22) Filed: Jan. 28, 2000

Related U.S. Application Data

(60) Provisional application No. 60/117,845, filed on Jan. 29, 1999.

(51) Int. Cl.[7] ..... E21B 43/10; E21B 19/16

(52) U.S. Cl. ..... 166/277; 166/207; 166/380

(58) Field of Search ..... 166/207, 277, 166/380, 384, 50, 242.1

(56) References Cited

U.S. PATENT DOCUMENTS

| | | | | |
|---|---|---|---|---|
| 3,067,801 A | | 12/1962 | Sortor | 153/80 |
| 3,191,677 A | * | 6/1965 | Kinley | |
| 3,785,193 A | | 1/1974 | Kinley et al. | 72/393 |
| 3,948,321 A | * | 4/1976 | Owen et al. | 166/277 |
| 3,976,134 A | * | 8/1976 | Berry | 166/120 |
| 5,785,120 A | | 7/1998 | Smalley et al. | 166/55 |
| 6,012,523 A | * | 1/2000 | Campberll et al. | 166/277 |
| 6,112,818 A | * | 9/2000 | Campbell | 166/384 |

FOREIGN PATENT DOCUMENTS

| | | |
|---|---|---|
| WO | WO98-00626 | 1/1998 |

* cited by examiner

*Primary Examiner*—David Bagnell
*Assistant Examiner*—Jennifer R. Dougherty
(74) *Attorney, Agent, or Firm*—Cantor Colburn LLP

(57) ABSTRACT

A flexible swage comprises a swage cup and a support receivable in a swage cup. The swage cup and support are separable in order to promote distinct purposes. The first purpose is to allow the swage to act as such and reform a deformed junction when the support is engaged with the swage cup thus supporting it against deflection. The second purpose is to remove the swage from the deformed junction at which time deflection in the swage cup is beneficial. Thus, the support is removed from engagement with the swage cup thereby allowing the swage cup to deform and be removed from the reformed junction more easily.

14 Claims, 4 Drawing Sheets

FLEXIBLE SWAGE

CROSS-REFERENCE TO RELATED APPLICATIONS

This application claims the benefit of U.S. Provisional Application No. 60/117,845 filed Jan. 29, 1999, which is incorporated herein by reference.

BACKGROUND OF THE INVENTION

1. Field of the Invention

The invention relates to oilfield downhole operations. More particularly, the invention relates to a swage device for reforming a deformable junction in a deviated wellbore.

2. Prior Art

As is well known to those of skill in the art, reformable deformed junctions have been known to the oilfield art. The benefit of a deformed junction is that the junction is easily transported through the casing of a wellbore or an open hole wellbore to its final destination at a junction between a primary and lateral borehole. Once the junction is properly positioned, it is reformed into a Y-shaped junction to assist in completing the wellbore. In the fully reformed condition of the junction, the outer dimensions are generally greater than the inside diameter (ID) of the casing or open hole. Thus, of course, it would be rather difficult to install the junction in its undeformed condition. Many methods have been used to reform the deformed junction in the borehole. One of the prior art methods has been to employ a swaging device. Swaging devices generally comprise a conical or frustoconical hardened member having an outside diameter (OD) as large as possible while being passable through the wellbore casing or the open hole. This swage is forced to travel through a previously positioned deformed junction whereby the junction is reformed into an operational position. Where the junction is located in a vertical or near vertical wellbore, setdown weight alone often is sufficient to generate the approximately 100,000 pounds of force required to reform the junction. Where the deformed junction is being placed in a highly deviated wellbore or a horizontal wellbore, however, setdown weight might not be sufficient to force the swage device through the junction. In this event, one of skill in the art will recognize the hydraulic procedure alternative to setdown weight. This hydraulic procedure includes an expansion joint located above the swage device, a drill tube anchor located above the expansion joint, and a ball seat located below the expansion joint such that by dropping a ball, pressure can be applied to the tubing string. This applied pressure forces the expansion joint to expand downhole, which in turn forces the swage device through the junction. Expansion joints are well known in the art, as are anchors and ball seats.

As also will be recognized by one of ordinary skill in the art, there is a significant drawback to the prior art swaging devices. The metal of the junction has a certain amount of resilience such that after the swage device has been forced through the junction, reforming the same, the junction itself will rebound to a smaller ID than the OD of the swage device by several thousandths of an inch. Because of the rebound it requires nearly as much lifting force on the swage device to remove it from the wellbore as is needed to initially force the swage through the deformed junction. This can be as much as 100,000 pounds. Although a drilling rig can easily pull ten times this weight, in a highly deviated or horizontal wellbore, the friction created on the curvature of the well can be high enough to absorb all of the force imparted at the surface and leave none available for the swage. Thus, the tool is stuck. The amount of force necessary to pull the swage through the newly reformed junction can also be sufficient to damage other well tools or junctions. Such damage can of course cost significant sums of money to repair and require significant time both to diagnose and to repair. Thus, the art is in need of a swage device that does not carry the drawbacks of the prior art.

SUMMARY OF THE INVENTION

The above-identified drawbacks of the prior art are overcome or alleviated by the flexible swage device of the invention.

The invention avoids the above set forth drawback by creating a two-part swage device comprising a support and a swage cup. The support is engaged with the swage cup during the swaging operation. The swage cup is moveable such that after the swaging operation is complete, the swage cup can be moved to a position where it is unsupported by the support and is therefore allowed to deflect several thousandths of an inch toward the mandrel. This deflection will significantly reduce drag on the swage cup through the reformed junction (and any other junctions uphole of the subject junction) during removal of the swage device from the wellbore. In an alternate embodiment, the swage cup contains longitudinal slots cut into it to impart increased flexibility characteristics to the swage cup. The flexible swage device of the invention is employable in place of a conventional swage, the function of which being fully assimilated in the invention.

BRIEF DESCRIPTION OF THE DRAWINGS

Referring now to the drawings wherein like elements are numbered alike in the several FIGURES.

DETAILED DESCRIPTION OF THE INVENTION

Figure 1:
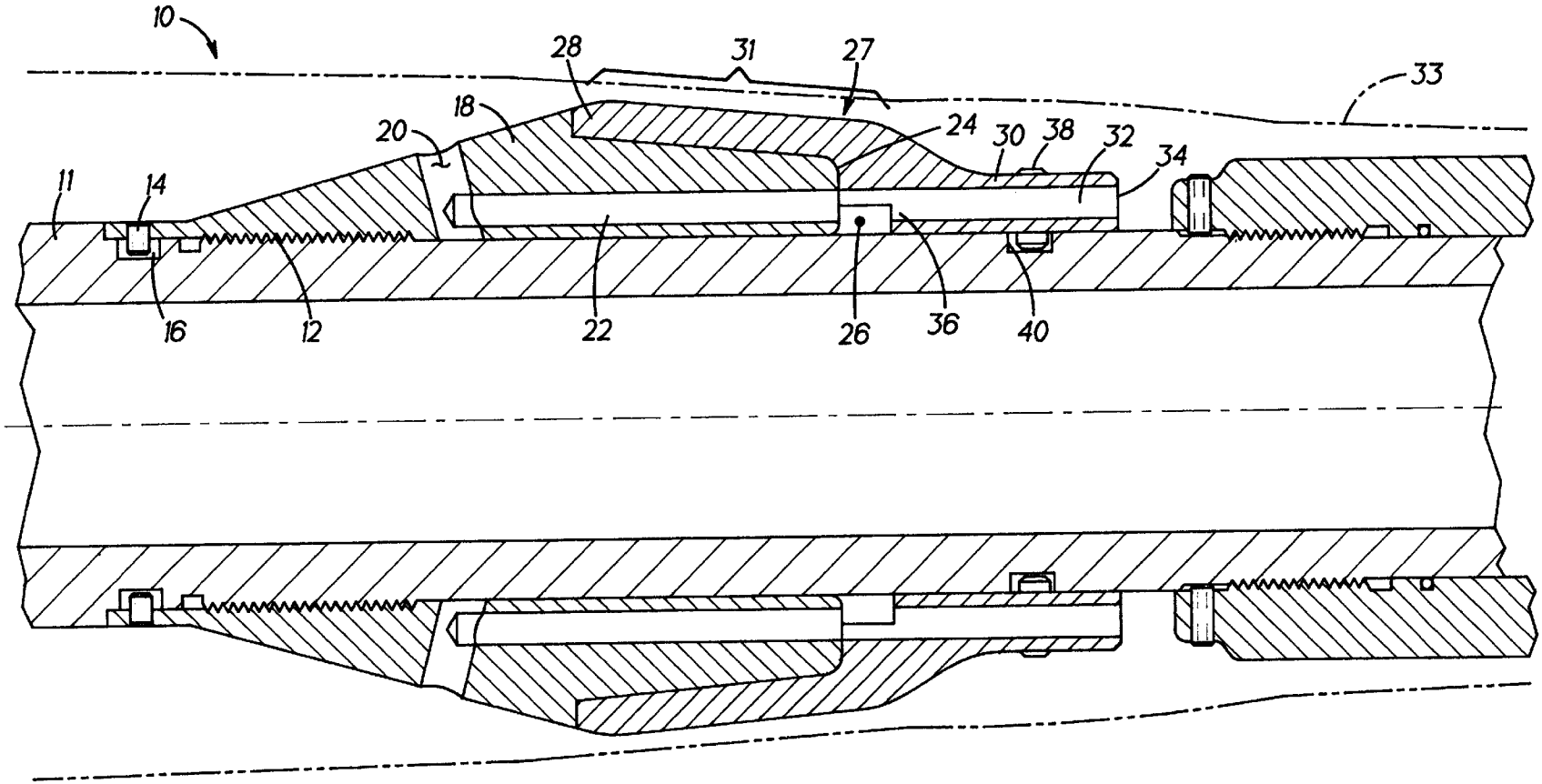
FIG. 1 is a side view of the invention in the swage position.

Referring to FIG. 1, a flexible swage in the swaging position is shown generally at 10. The invention is illustrated mounted on a mandrel 11 by a regular threaded connection 12 and a plurality of set screws 14. Each set screw 14 is received in a groove 16, the combination of which with screw thread 12 prevents movement of a support 18. Support 18 is preferably a frustoconical annular element of a single piece although multiple pieces could be used to achieve the result of the invention. Support 18 is provided with at least one port 20 (preferably several ports 20) that exits support 18 uphole of a point of contact of the swage device with the inner wall of a junction being deformed (not shown). Port 20 also intersects a bore 22 of which there may be several and preferably will be as many as there are ports 20, which extends through support 18 to a downhole end 24 thereof. Bore 22 is open to annular space 26 as illustrated. As should be understood, there may be several bores 22 that open into annular space 26. Support 18 can be seen in the drawing (FIG. 1) to matingly receive and support a swage member 27.

Figure 4:
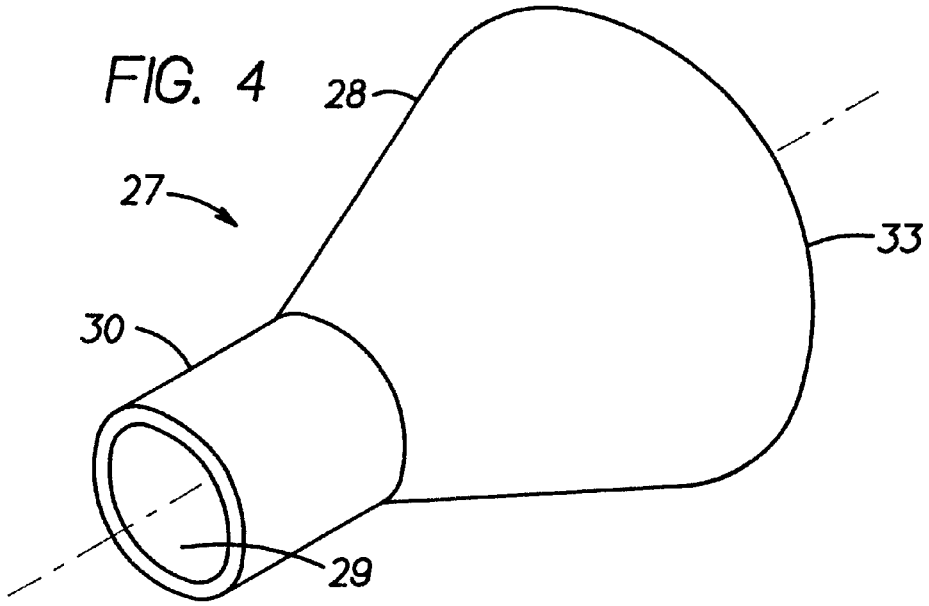
FIG. 4 is a perspective view of the swage cup.

Referring now to FIG. 4, one embodiment of the swage member of the invention is shown separately from other components of the invention. The swage member is numeralled 27. Swage member 27 comprises a swage cup 28 and a swage base 30 and is a frustoconical annular element preferably of a single piece. Alternately, multiple pieces could be used to form swage member 27. In either case, swage cup 28 extends upwardly and outwardly from swage cup base 30. A hole 29 extends axially through swage cup 28 and swage cup base 30 and is of a size sufficient to allow swage member 27 to receive mandrel 11. An uphole end 33 of swage cup 28 is substantially hollowed out and configured to matingly accommodate support 18, thereby preventing the deflection of the outer perimeter of swage cup 28 toward mandrel 11.

Figure 5:
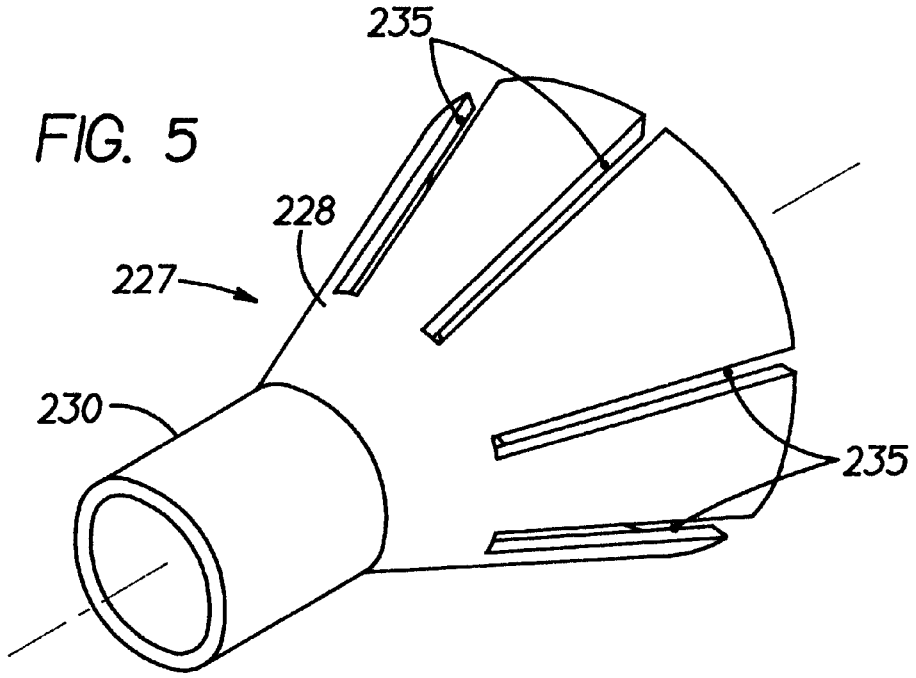
FIG. 5 is a perspective view of an alternate embodiment of the swage cup.

Turning now to FIG. 5, an alternate embodiment of the swage member of the invention is illustrated generally at 227. This alternate embodiment comprises swage cup 228 and swage cup base 230. Swage cup 228 is still of a generally frustoconical shape and is still preferably fabricated from a single piece of material, as in the previous embodiment. However, swage cup 228 contains a plurality of longitudinal slots 235 cut therein and extending toward swage cup base 230. Slots 235 render swage cup 228 more flexible than the first described embodiment. The greater flexibility, it will be understood, is due to the kerf width of slots 235. Since it is possible during compression of swage cup 228 to "close" the kerf of slots 235, a greater reduction in the outside diameter of swage cup 228 is achievable. Slots 235 make retrieval of the tool easier without compromising the swaging action of the tool in the first instance.

Referring back to FIG. 1, swage cup base 30 includes bore 32 open on a downhole end 34 of swage cup base 30 to the well fluid downhole of a contact area 31 of swage cup 28 with the inside dimension of a deformable junction 33 (shown in phantom lines). Bore 32 extends to an uphole end 36 which communicates with annular space 26. Annular space 26 ensures communication between bore 32 and bore 22 thus effecting through-passage of well fluids from below contact area 31 of swage cup 28 with the inside dimension of deform able junction 33 (effectively a metal-to-metal seal) to the outlet of port 20 above contact point 31. A means for fluid flow (such as bore 22) through swage 10 is necessary to provide an outlet for the build up of fluid pressure downhole of swage cup 28. By providing a bore through swage cup 28, the conditions allowing for the formation of this hydraulic lock under swage cup 28, which would otherwise hinder and possibly prevent movement of swage 10 through the junction, are defeated.

Swage cup 28 and swage cup base 30 are located on mandrel 11 by shear screws 38 only. Swage cup 28 and swage cup base 30 are preferably a single annular component that is slideable along mandrel 11. Therefore, some means of holding swage cup 28 and swage cup base 30 in the swaging position on support 18 is needed for the invention to function as intended. One embodiment of such means is through the use of shear screws 38, which are received in groove 40. It will be recognized by one of ordinary skill in the art that since shear screws 38 are the only means in this embodiment which hold swage cup 28 and swage cup base 30 in place, swage cup 28 and swage cup base 30 may rotate 360° around mandrel 11 relatively freely. The significance of annular space 26 then is to ensure that bore 32 is in fluid communication with bore 22 regardless of the orientation swage cup 28 and swage cup base 30 have relative to support 18.

Figure 2:
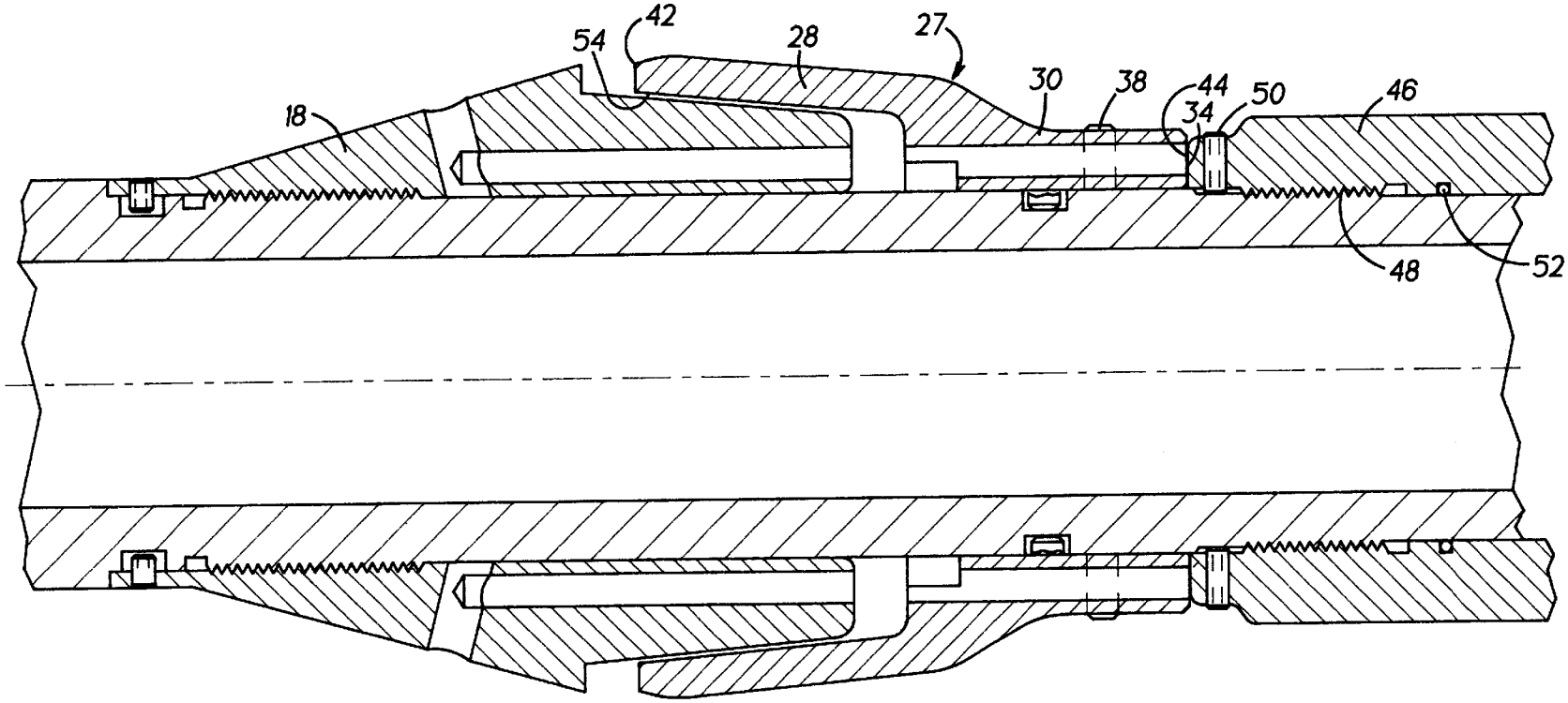
FIG. 2 is a side view of the invention wherein the swage cup has been sheared to a second position, which is the retrieving position.

In the condition shown in FIG. 1, one of ordinary skill in the art will appreciate that as swage 10 is forced downhole, it will quite effectively reform a deformed junction similarly to prior art swages. Once the reformation is complete and it is desirable to remove swage 10 from the wellbore, an upward pull is necessary. Referring now to FIG. 2, upon pulling the tool in the upward direction, a point 42 of swage cup 28 will contact the inner walls of the junction due to the resilience of the junction as discussed hereinbefore. The pressure on point 42 will tend to prevent swage 10 from moving uphole. This force is translated through swage cup 28 and swage cup base 30 to screws 38, which will then shear under that force. One of skill in the art will recognize that the particular amount of force required to shear screws 38 is engineerable in advance and should be matched to an appropriate amount of force to indicate that withdrawal of the tool is desired. Upon shearing of screws 38, swage cup base 30 and swage cup 28 move downhole until downhole end 34 of swage cup base 30 is in contact with an uphole end 44 of a swage stop 46. It should be briefly noted at this point that swage stop 46 is connected to mandrel 11 via a regular thread 48 and a plurality of set screws 50. Swage stop 46 further includes an o-ring 52 to seal swage stop 46 against mandrel 11.

Upon shifting swage cup 28 and swage cup base 30 downhole into contact with uphole end 44 of swage stop 46, a gap 54 is formed between swage cup 28 and support 18. Because of gap 54, continued pulling on swage 10 causes swage cup 28 to deflect inwardly toward mandrel 11 to a degree which is sufficient to allow swage member 27 to slide through the junction. The deflection of swage cup 28 is typically several thousandths of an inch. Gap 54 may be as small as several thousandths of an inch, or it may be larger. The deflection of swage 28 will merely be what is necessary for swage 10 to move through the junction at a significantly reduced force as it is being withdrawn from the well.

Figure 3:
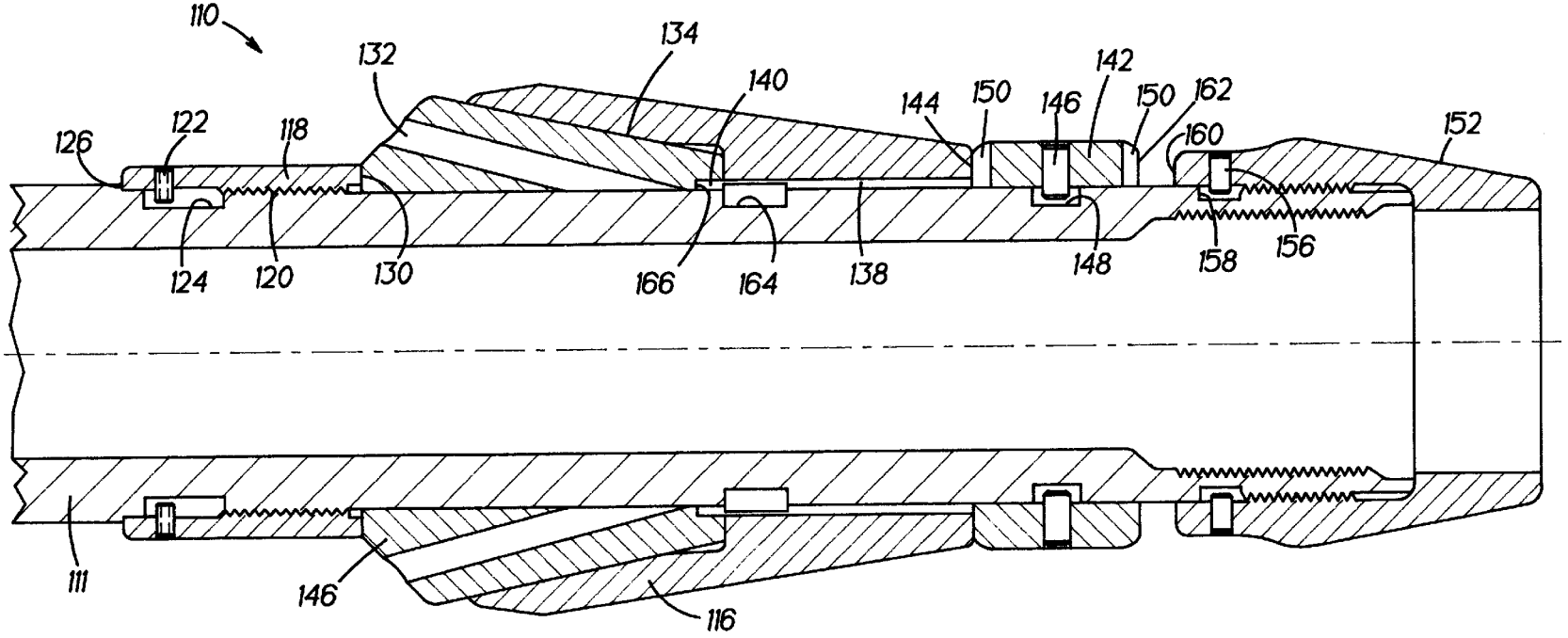
FIG. 3 is a cross section view of a second embodiment of the invention.

In a second embodiment of the invention, referring now to FIG. 3, the general mode of operation of the swage remains the same, but the way in which it is carried out is slightly different. Since each of the components of this embodiment is slightly different than each of their counterparts in the first described embodiment, new numerals are used for each.

A mandrel 111 supports a swage 110, which is activated through the movement of mandrel 111. In the running position (shown), a swage ring support 114 is in position to support a swage ring 116. Both swage ring support 114 and swage ring 116 in this embodiment "float" on mandrel 111 (i.e., they are not attached to mandrel 111). At the uphole end of mandrel 111, swage ring support 114 is prevented from moving further uphole by a retaining ring 118. Retaining ring 118 is threadedly connected to mandrel 111 by a thread 120 and prevented from moving on thread 120 by at least one set screw 122, which is received in a groove 124. In a preferred embodiment, mandrel 111 is "turned down" to form a shoulder 126 extending to the downhole end of swage 110 and is configured such that retaining ring 118 firmly abuts shoulder 126. Configuring mandrel 111 to contain shoulder 126 provides more annular space between the "turned down" surface of mandrel 111 and the borehole or junction so that thicker swage components may be used. The "turn down" of shoulder 126 also lends extra stability to retaining ring 118.

Swage support 114 abuts retaining ring 118 at interface 130 and includes fluid bypass 132. Support for swage ring 116 is along interface 134. As a unit, support 114 and swage ring 116 function as their counterparts did in the previous embodiment and indeed as do those of the prior art to reform a deformed junction. It is with the recovery of swage 110 that its unique construction is evident and beneficial. It should be noted that swage ring 116 includes at least one fluid bypass conduit 138 that communicates with an annulus 140.

Downhole of swage ring 116 is a shear ring 142. Swage ring 116 abuts shear ring 142 at interface 144. Shear ring 142 is prevented from longitudinal movement on mandrel 111 by a plurality of shear screws 146, which extend into groove 148 on mandrel 111. Shear ring 142, together with retaining ring 118, maintains swage ring support 114 and swage ring 116 in the operative running and reforming position. It should be noted that slots 150 are provided on both the uphole and downhole sides of shear ring 142 in a preferred embodiment. While only the uphole end of shear ring 142 requires slots 150 to allow fluid bypass, placing slots 150 on both ends avoids the possibility that swage 110 might be assembled backwards.

At the downhole end of swage 110 in FIG. 3 (i.e., the right side of the drawing), a dual function nose swage 152 is threadedly attached to mandrel 111 at a thread 154 and locked in place by at least one set screw 156 received in groove 158. Nose swage 152 acts to prevent shear ring 142 from falling off the end of mandrel 111 after shear screw(s) 146 are sheared and also acts as a pre-reforming swage to open up tightly deformed junctions.

In the operational condition, with shear screw(s) 146 intact, the space between uphole end 160 of nose swage 152 and downhole end 162 of shear ring 142 is preferably sufficient to allow full shearing of shear screw(s) 146 by displacement of shear ring 142 in the downhole direction before the noted surfaces touch. This prevents a partial shearing condition which may impede performance to some degree. The partial shearing, however, should not completely prevent swage 110 from performing.

Once swage 110 has been forced through the junction being reformed it will be withdrawn or pulled uphole. In the event that the swage encounters significant resistance, the features of the invention will be set in motion. Since both the swage ring support 114 and swage ring 116 are not connected to mandrel 111, resistance provided by the deformed junction is translated directly to shear screw(s) 146. At a predetermined amount of force, screw(s) 146 will shear and allow mandrel 111 to move uphole. At this point, support 114 has not been moved relative to swage ring 116. Thus, the frictional engagement therebetween is rendered independent and not cumulative with respect to the amount of force necessary to shear screw(s) 146. Upon the movement of mandrel 111 uphole, a snap ring 164 impacts a shoulder 166 on support 114 and will move support 114 out of its support position under swage ring 116. This, as in the previous embodiment, allows swage ring 116 to flex, thereby allowing swage 110 to be retrieved. In practice, the disengagement of support 114 with swage ring 116 is assisted by a jarring action that normally results from the sudden shear of screw(s) 146. It should be noted, however, that a straight pull on swage 110 would also dislodge support 114 from swage ring 116. The jarring action is a likely mode of operation; however, it is not a required mode of operation. Overcoming the friction generated by flexible swage ring 116 being urged into contact with support 114 as a result of contact between the swage ring 116 and inner walls of the junction is all that is necessary. After shearing, swage ring 116 and shear ring 142 will rest on nose swage 152 while support shoulder 166 will rest on snap ring 164. In this condition, support for swage ring 116 is not available and it is free to flex allowing swage 110 to be recovered from the junction. Commonly, the flexing that will occur is into a slight oval shape.

It should be appreciated that in both embodiments of the invention the shear release or other release mechanism may not be used in all conditions. Swage 10 may pull through the junction without needing to be flexible. Because these tools incorporate the invention, the tools are retrieved whether or not swage 10 gets stuck in the junction. If swage 10 does get stuck in the junction, shear screw(s) 146 will shear on continued pickup of swage 10 and swage 10 will operate as hereinbefore described.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A flexible swage for reforming a deformed junction in a wellbore comprising:

a support locatable on a mandrel; and a single piece swage member moveable on said mandrel into a position where said member is supported by said support and a position where said member is unsupported by said support, said member being deflectable when in said unsupported position.

2. A flexible swage as claimed in claim 1 wherein said swage member is rendered temporarily unflexible by a defeatable condition.

3. A flexible swage as claimed in claim 2 wherein said defeatable condition is at least one shear screw.

4. A flexible swage as claimed in claim 1 wherein said swage further comprises a swage stop mountable to said mandrel.

5. A flexible swage as claimed in claim 4 wherein said stop is a prereforming swage.

6. A flexible swage as claimed in claim 1 wherein said flexible swage further comprises a flow path through said support and said member to allow fluids to pass through said flexible swage.

7. A flexible swage as claimed in claim 1 wherein said swage member comprises a substantially frustoconically-shaped element having a hole disposed axially therethrough, said hole being dimensioned to receive said mandrel therethrough.

8. A flexible swage as claimed in claim 7 wherein said swage member contains a plurality of slots longitudinally disposed therein, said slots imparting flexibility characteristics to said swage member.

9. A flexible swage as claimed in claim 8 wherein said swage member is formed from a single piece of material, thereby making said base portion and said longitudinal elements a single contiguous member.

10. A method for reforming a deformed junction for a wellbore comprising:

urging a single piece swage member supported by a support through said junction;

picking up on said single piece swage;

defeating a defeatable member;

unsupporting said single piece swage member thereby allowing said swage member to deflect inwardly from its static unbiased position due to inward radial strain produced by a tubular through which said member is moved; and withdrawing said single piece swage member and said support from said wellbore.

11. A method as claimed in claim 10 wherein said defeating is shearing.

12. A method as claimed in claim 10 wherein said defeating is a two step process.

13. A method as claimed in claim 12 wherein said two step process comprises shearing and overcoming friction between said support and said single piece swage member.

14. A method as claimed in claim 12 wherein said two steps are independent.

* * * * *